US005358174A

United States Patent [19]

Antczak et al.

[11] Patent Number: 5,358,174

[45] Date of Patent: Oct. 25, 1994

[54] CONTAINER

[76] Inventors: Edwin A. Antczak, 11200 S. Octavia Ave., Worth, Ill. 60482; Mark O. Faltynek, 3424 W. 82nd St., Chicago, Ill. 60652; Daniel F. Garbaczewski, 13713 Cave Creek Ct., Lockport, Ill. 60441; James J. Garbaczewski, 8175 S. Tripp St., Chicago, Ill. 60652

[21] Appl. No.: 189,915

[22] Filed: Feb. 1, 1994

[51] Int. Cl.[5] ..... B65D 5/56

[52] U.S. Cl. ..... 229/110; 220/443; 229/120; 229/198.2; 229/939; 229/103.3

[58] Field of Search ..... 229/40, 110, 120, 198.2, 229/902, 906, 939; 220/416, 418, 441, 443; 206/424

[56] References Cited

U.S. PATENT DOCUMENTS

| | | | |
|---|---|---|---|
| 659,943 | 10/1900 | Warner . | |
| 1,324,144 | 9/1919 | Cone . | |
| 1,449,409 | 3/1923 | Hunt . | |
| 1,849,065 | 3/1932 | Biederman . | |
| 2,012,131 | 8/1935 | Kondolf | 229/16 |
| 2,533,773 | 12/1950 | De La Foret | 229/6 |
| 2,547,005 | 4/1951 | Herrick et al. | 229/90 |
| 2,782,977 | 2/1957 | Thompson | 229/14 |
| 3,042,278 | 7/1962 | McCullough | 225/39 |
| 3,084,843 | 4/1963 | Urban | 229/16 |
| 3,098,563 | 7/1963 | Skees | 206/46 |
| 3,144,979 | 8/1964 | Young | 229/41 |
| 3,203,617 | 8/1965 | Paige | 229/39 |
| 3,203,618 | 8/1965 | Andrews et al. | 229/40 |
| 3,254,827 | 6/1966 | Chapman | 229/198.2 |
| 3,486,681 | 12/1969 | Radtke et al. | 229/939 |
| 3,521,812 | 7/1970 | Moers et al. | 229/39 |
| 3,616,989 | 11/1971 | Martinek et al. | 229/32 |
| 3,884,352 | 5/1975 | Pilz, III et al. | 206/424 |
| 3,896,990 | 7/1975 | Sieffert | 229/40 |
| 3,931,926 | 1/1976 | Bensen | 229/45 |
| 3,944,131 | 3/1976 | Weiss | 229/40 |
| 3,973,721 | 8/1976 | Nakane | 229/30 |
| 4,373,636 | 2/1983 | Hoffman | 206/551 |
| 4,441,626 | 4/1984 | Hall | 220/443 |
| 4,721,243 | 1/1988 | Mercurio | 229/137 |
| 5,004,147 | 4/1991 | Bienaime | 229/198.2 |
| 5,094,385 | 3/1992 | Antczak et al. | 229/110 |

FOREIGN PATENT DOCUMENTS

| | | |
|---|---|---|
| 977069 | 12/1964 | United Kingdom . |
| 1033661 | 6/1966 | United Kingdom . |

*Primary Examiner*—Gary E. Elkins

*Attorney, Agent, or Firm*—Marshall, O'Toole, Gerstein, Murray & Borun

[57] ABSTRACT

A container with an improved closure system and other improved features made of a single-faced paperboard blank formed of a corrugated paperboard layer and a substantially flat paperboard layer. The blank has scored lines or cuts which define a bottom portion, a cover, a cover support and four side walls. The boundaries of the side walls are defined by a plurality of substantially parallel scores and cuts that meet at a plurality of points so as to form side walls which have generally triangular ends. The improved closure system comprises at least one locking tab integrally formed in the cover and which has a plurality of flutes and at least one locking receptacle integrally formed in the bottom portion and which has an edge. Each corresponding receptacle and tab positionally coincide when the container is assembled so that a flute of the locking tab engages the flat paperboard layer by the edge of the receptacle to facilitate a closure.

14 Claims, 2 Drawing Sheets

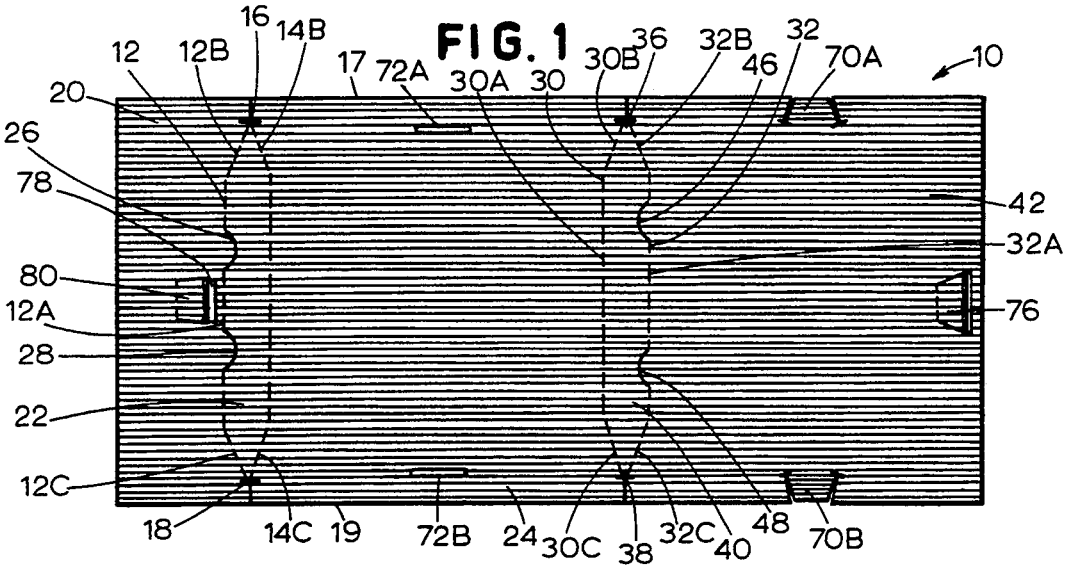
FIG. 1
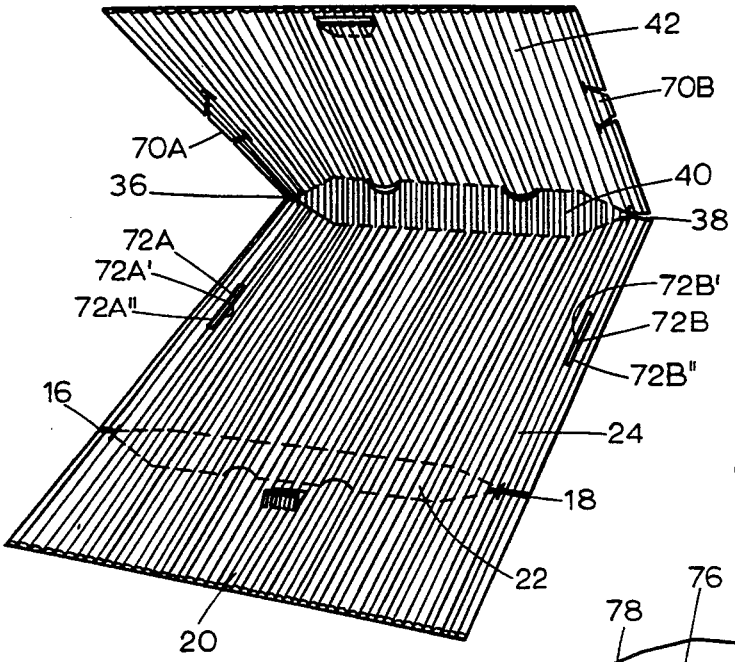
FIG. 2
FIG. 5
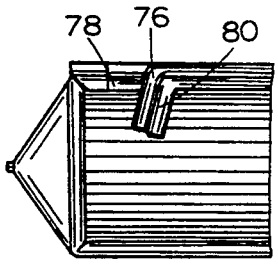
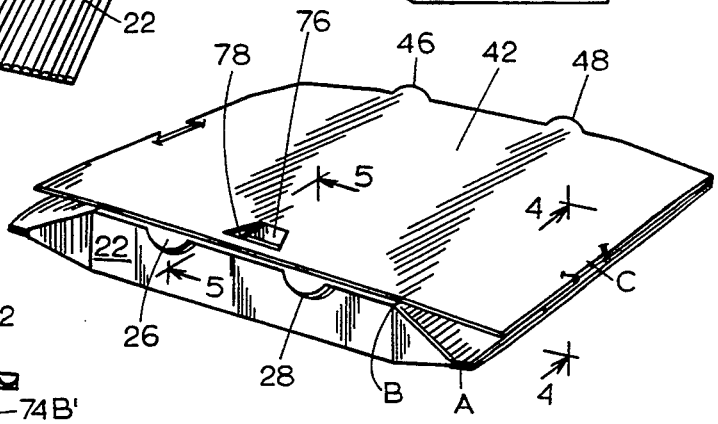
FIG. 3
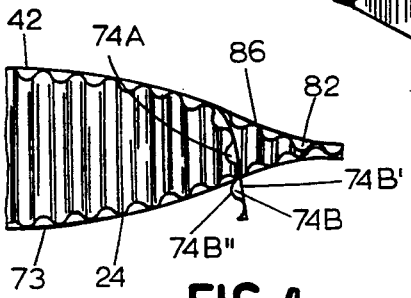
FIG. 4

CONTAINER

FIELD OF THE INVENTION

The present invention relates to containers, primarily for temporarily storing and/or delivering prepared hot or cold foods, and more particularly to improved features for these containers.

BACKGROUND OF THE INVENTION

Corrugated containers are frequently used to temporarily store foods that have been heated. For example, corrugated boxes are often used to store pizzas during delivery. Such a corrugated box is traditionally made from a triple sheet of paper (doublefaced corrugated) that has been selectively cut and creased to facilitate folding the sheet of corrugated material into a box. Desirable characteristics for a food container such as a box include sufficient rigidity to prevent collapse of the box under strain, sufficient thermal characteristics to prevent the food item from severe temperature change, and sufficient ventilation to allow escape or retention of moisture from the interior of the box to prevent the food item from becoming soggy or dehydrated.

Prior pizza boxes or containers suffer from several disadvantages. Most pizza boxes suffer from a complicated assembly procedure requiring many folds. This tedious and time consuming procedure typically requires pizza vendors to assemble a multitude of boxes before they prepare the pizzas so that customers can be served quickly during peak times. Since the assembled boxes require more space than the flat layers from which they are formed, these boxes take up precious storage space. In addition, more man hours are necessary to assemble the boxes.

In addition, most pizza boxes also suffered from being susceptible to grease which can weaken the box and from cheese sticking to the interior surface of the box. Further, many pizza boxes generate inedible cardboard cut out portions during their assembly.

Commonly owned U.S. Pat. No. 5,094,385 which is incorporated herein by reference, solved most of these problems and provided a strong, rigid box that excellently controlled the interior humidity and moisture of the box and which was very simple to assemble. The present invention improves the containers disclosed therein.

SUMMARY OF THE INVENTION

The present invention, a food container, or box, for temporarily storing a food item, such as pizza is a great improvement over the previous food containers. The container of the present invention is easier to assemble than prior containers and has a improved closure mechanism which has a greater resistance to disengagement in use than similar closure mechanisms. The closure mechanism of the present invention will keep the container closed even when portions of the container twist or move due to in-use stresses. The closure mechanism also helps to provide the container with excellent stacking strength and excellent center crush strength. Finally, the container design provides an excellent thermal and humidity environment for the food in the container.

The box is formed of two layers, a flat paperboard layer and a corrugated paperboard layer. The two layers are typically bonded together by a conventional adhesive, as appropriate for the specific application.

The combination of the two paperboard layers bonded together is referred to as single-faced board. When the box is assembled, the flat paperboard layer faces the exterior of the box and the corrugated layer having a plurality of substantially parallel flutes faces the interior of the box. As a result, when a food item such as a pizza is placed inside the box, the pizza is supported on the parallel flute of the corrugated layer in the bottom of the box so that air may circulate between the crust of the pizza and the bottom of the box to prevent the crust from becoming soggy. Since the box consists of only two paperboard layers, a substantial amount of material is saved in the construction of the box. Since the carton blank is rectangular in shape, it is unencumbered with protruding tabs and will sustain little or no damage during shipping.

The box has an advantageous structure that enhances the strength of the box while being very simple in design. In particular, the box is formed by folding the single-faced board described above in accordance with four scored lines in the board. The four scored lines are made by crushing the corrugated layer, but not the flat layer; however, other methods of forming lines could be used. As a result, the folding of the board along the lines is easily accomplished.

The pattern of the four scored lines allows for very easy folding of the box as well as enhancing structural integrity of the box. A first pair of the lines define a first substantially planar side wall between a cover support portion of the box and the bottom of the box. These two lines are substantially parallel, but meet at two respective y-shaped (or t-shaped) cuts at the edges of the single-faced board. As a result of the meeting of the lines, the side wall thus formed has ends that are generally triangular in shape and y-shaped cut. A second pair of lines is formed similarly to the first pair, and thus defines a second substantially planar side wall with triangular ends between a cover of the box and the bottom of the box.

The particular pattern of scored lines and y-shaped cuts enhances the strength of the resultant box and simplifies the folding of the board when forming the box. The folding of the board is simplified because the two folds in each of the two side walls are made automatically when the board is bent, and because there is no need to make additional folds to form the third and fourth side walls of the box which are formed partly by the cover and partly by the bottom.

The improved primary closure system of the present invention comprises at least one locking tab and at least one corresponding locking receptacle. The locking tab is integrally formed with the cover and has a substantially flat layer adhesively attached to a corrugated layer which has a plurality of flute. The corresponding locking receptacle is integrally formed on the bottom and has an edge parallel to the corrugated flutes on the bottom. When the box is assembled, the locking receptacle is aligned so that the corresponding locking tab can be bent downwards to enable a flute to engage the flat layer of the bottom at the receptacle edge to facilitate a closure of the cover to the bottom.

The closure can be maintained, if necessary, by several means. The locking receptacle may comprise a slit into which a locking tab is inserted and which has a width that is less than the height of the flute of the locking tab that engages the flat layer.

An alternative means of the present invention to maintain the fluted engagement comprises an alternative locking receptacle that has three edges and a locking tab that is wide enough so that a first and second portion of the tab frictionally engages the second and third edges of the locking receptacle. Typically at least a portion of both the second and the third edge of the receptacle are parallel to each other and the tab is wider than the distance between these two parallel portions.

The present invention also only requires two sets of corresponding locking tabs and receptacles. One set of corresponding locking tabs and receptacles of the present invention is located in the center of the length of the third sidewall and one set located in the center of the length of fourth sidewall. In addition to using the minimum number of closure mechanisms, the center location of the closure mechanisms enables the box to have greater center crush strength and greater stacking strength.

As discussed above, the ends of the first and second sidewalls are advantageously y-cut. This allows a portion of the interior of the cover and the bottom to lie flat next to one another between the opposing y-cut ends of the first and second sidewalls when the box is assembled. This also allows a portion of the parallel flutes of the cover to intimately mate with the recesses of the parallel flutes of the bottom and a portion of the parallel flutes of the bottom to intimately mate with the recesses of the parallel flutes of the cover to prevent thermal loss from the interior of the container.

The present invention also advantageously has an auxiliary locking mechanism which is normally engaged before the primary closure to properly align the locking tabs and receptacles of the container. The auxiliary locking mechanism has an auxiliary tab on the cover and an auxiliary receptacle on the cover support portion. The position of the auxiliary tab coincides with the auxiliary receptacle when the container is assembled so that the auxiliary tab can be bent downward to frictionally engage the receptacle to form a closure between the cover and cover support.

The container also advantageously has a first and second pair of vents respectively on the first and second sidewalls. The distance between the first pair of vents is different than the distance between the second pair of vents which creates offset edge vents which advantageously provides cross-current moisture venting.

These and other objects, features, and advantages of the present invention will be apparent to those of ordinary skill in the art in view of the detailed description of the preferred embodiments, which is made with reference to the drawings, a brief description of which is provided below.

BRIEF DESCRIPTION OF THE DRAWINGS

FIG. 1 is a top view of a food container or container blank of the present invention;

FIG. 2 is a perspective view of the container of FIG. 1 in a partially folded configuration;

FIG. 3 is a perspective view of the container in its assembled state;

FIG. 4 is a partial side view of the container taken along lines 4—4 in FIG. 3;

FIG. 5 is a partial side view of the container taken along lines 5—5 in FIG. 3.

DETAILED DESCRIPTION

Figure 6:
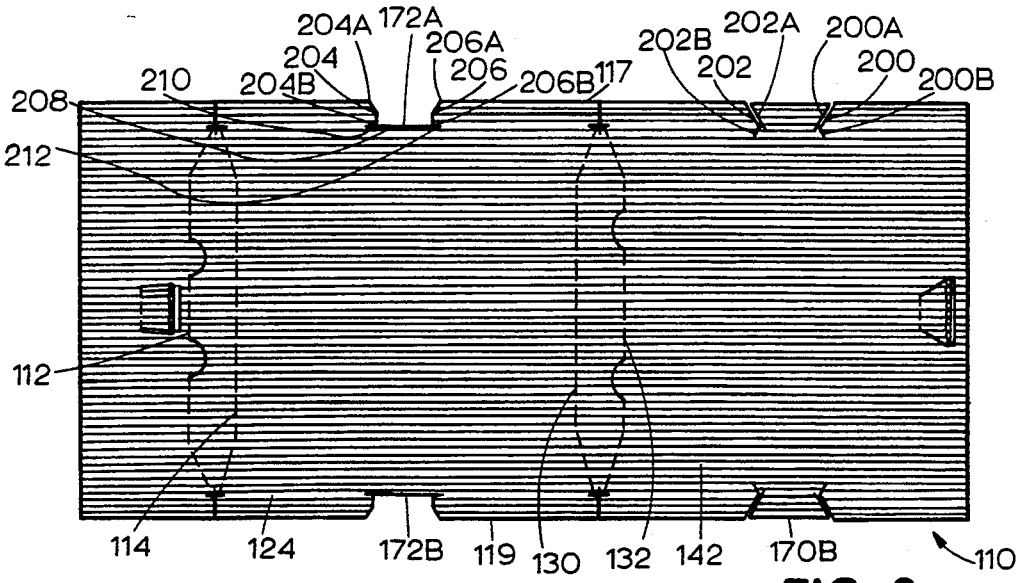
FIG. 6 is a top view of an alternative embodiment of the food container or container blank having an alternative locking tab closure.

The present invention is formed from a rectangular sheet of corrugated paperboard 10 as shown in FIG. 1. The sheet of paperboard 10 comprises two layers of paperboard, a flat layer and a corrugated layer bonded directly to the flat layer in a conventional manner by adhesive. The flat layer of paperboard may be 42 pounds per ream weight kraft paper, based upon a ream size of 500 sheets of 24" by 36" sheets, and the corrugated layer may be 33 pounds per ream weight kraft paper. The corrugated layer consists of a plurality of parallel flutes, or semicircular raised portions, and a plurality of parallel recesses between the flutes. Various sizes of corrugations of flutes commonly known in the corrugated industry could be used. The adhesive used to bond the two layers together may be a corn starch based adhesive commonly used in the corrugated industry. The combination of a flat layer of paperboard and a corrugated layer as described above is referred to in the corrugated industry as single-faced corrugated board.

The paperboard making up the flat layer and or the corrugated layer may be treated with an antistaining treatment such as Minnesota Mining and Manufacturing's FDA approved Scothban FC-807 or FX-845 flourochemical treatments. When the container of the present invention is used as a hot pizza container, the treatment provides the paperboard with both resistance to grease which can reduce the strength of the paper board and cheese release properties which prevents cheese from sticking to the paperboard and allows easier pizza slice removal.

The single-faced corrugated board 10 of FIG. 1 has a number of scores formed therein to facilitate folding of the board into a box. Now referring to FIG. 1, a first pair of scores, as indicated by dotted lines 12, 14, extend across almost the entire width of the board 10. Scores that are represented by dotted lines in FIGS. 1 and 2 extend through both layers of the board 10. The scores shown by dotted lines are made to facilitate folding the board into a box.

Each of the scores 12, 14 has a substantially linear first portion 12A, 14A and two substantially linear second portions 12B, 12C, 14B, 14C. The first linear portions 12A, 14A of the scores 12, 14 are substantially parallel to each other and are substantially parallel to the width of the board 10. One of the linear second portions 12B of the score 12 substantially joins one of the second linear portions 14B of the score 14 at a first y-shaped cut 16 near the top edge 17 of the board 10 in FIG. 1, and these two portions 12B 14B of the scores 12, 14 generally form two sides of a triangle. The other two linear second portions 12C, 14C of the scores 12, 14 join at a second y-shaped cut 18 near the bottom edge 19 of the board 10, and these portions generally form two sides of another triangle. The y-shaped cuts 16, 18 lie between the two linear extensions of the substantially linear first portions 12A, 14A of the scores 12, 14, and the area of the board 10 between the scores 12, 14 is not crushed (or scored).

The scores 12, 14 define three portions: a cover support portion 20 to the left of the score 12, a first side wall 22 in between the scores 12, 14, and a bottom portion 24 to the right of the score 14. When the board 10 is folded into a box, the portion 20 will act as a support for the cover of the box and will hold the top of the side wall 22 in place. The ends of the side wall 22 terminate at the y-shaped cuts 16, 18 and are generally triangular in shape due to the second substantially linear portions of the scores 12B, 12C, 14B, 14C meeting at the y-shaped cuts 16, 18. The score 12, which defines the top edge of the side wall 22 when the board is folded into a box, has two semicircular cuts 26, 28 which pass through both layers of the board 10 to define semicircular vents to allow the escape of moisture from the interior of the box.

The semicircular cuts forming the vents are advantageous in that no waste board or corrugated cutouts are formed when the board is folded into a box. This is important because otherwise all cutouts would have to be removed from the board 10 so that no cutouts would be inadvertently left within the food container and accidentally swallowed.

A second substantially parallel pair of scores, as indicated by dotted lines 30, 32, extend across almost the entire width of the board 10. Each of the scores 30, 32 has a substantially linear first portion 30A, 32A and two substantially linear second portions 30B, 30C, 32B, 32C. The first linear portions of the scores 30A, 32A are substantially parallel to each other and are substantially parallel to the width of the board 10. One of the second linear portions 30B of the score 30 substantially joins one of the second linear portions 32B of the score 32 at a first y-shaped cut 36 near the top edge 17 of the board 10 in FIG. 1, and these two portions of the scores 30B, 32B generally form two sides of a triangle. The other two second linear portions 30C, 32C of the scores 30, 32 join at a second y-shaped cut 38 near the bottom edge 19 of the board 10, and these portions generally form two sides of another triangle. The y-shaped cuts 36, 38 lie between the two linear extensions of the substantially linear first portions 30A, 32A of the scores 30, 32, and the area of the board 10 between the scores 30, 32 is substantially unscored.

Score 32 is a perforated score to facilitate the top of this container to be torn away and used as a serving tray by itself separate from the rest of this container (Portion 42). The 30, 32 define three portions: the bottom portion 24, a second side wall 40, and a top portion or cover 42. The perforated 32 includes two semicircular cuts 46, 48 through both layers of the board 10 to define a second pair of semicircular vents.

As seen in FIGS. 1–3 the distance between the centers of semicircular cuts 46 and 48 is greater than the distance between the centers of semicircular cuts 26 and 28. As seen best in FIG. 3, this creates vents on the top edge of the first side wall that are offset from the vents on other sidewall when the board is folded into the box. This means that a line from the center of either vent 26 or 28 on the first side wall 22 to the center of either vent 46 or 48 on the second side wall 40 will not be perpendicular to either wall 22 or 40. This offset edge venting provide cross current moisture venting for control of moisture and thermal properties within the formed box. The humidity and thermal properties desired can be varied by either varying the sizes of the vents and/or varying how far the vents on one side wall are offset from the vents on the other side wall.

In addition to the external semicircular vents, the container can have an internal venting system, as described in above referenced U.S. Pat. No. 5,049,385 to further control the internal humidity and thermal properties of the box.

The board 10 also has two locking tabs 70A and 70B. Locking tab 70A is formed in the center of the length the cover portion 42 by the top edge 17 of the board 10. Locking tab 70B is formed in the center of the length of the cover portion 42 by the bottom edge 19 of the board 10. Each tab 70 is formed by a pair of angled or converging cuts connected by third cut, all through both layers of the board 10. The board 10 also has two corresponding locking receptacles 72A and 72B formed in the center of the length of the bottom portion 24 respectively by the top 17 and bottom 19 edges of the board 10. Receptacles 72A and 72B consist of a linear slit through both portions of the board 10. The receptacles 72A and 72B each have two edges 72A', 72A" and 72B', 72B" generally parallel to each other and parallel to the plurality of corrugated flutes 73 on the bottom 24.

The locking tabs 70A, 70B and the locking receptacles 72A, 72B comprise the primary closure system for the container. The tabs 70A, 70B are positioned such that each tab positionally coincides with corresponding locking receptacles 72A, 72B to facilitate the tight closure of the box. In particular, when the board 10 is folded into a box, the tab 70A of the cover 42 lies directly over the locking receptacle 72A in the bottom portion 24. In addition, the tab 70B formed in the cover 42 lies directly over locking receptacle 72B formed in the bottom portion 24. When the board 10 is folded along the four score lines 12, 14, 30, 32 and the tabs 70A, 70B overlie the locking receptacle 72A, 72B as described above, the box is sealed by bending the tabs 70A, 70B to a downward pointing direction, as shown in FIG. 4 inserting each tab 70A, 70B through the corresponding locking receptacle 72A, 72B such that a corrugated flute 74 of the tab 70A, 70B engages the flat layer of paper board on the bottom portion 24 to facilitate the tight closure of the box. The tightness of the closure can be varied by using a different flute 74 to engage the flat paperboard layer. For example, using flute 74A to engage the paperboard layer will produce a tighter closure than using flute 74B for engagement.

This engagement is maintained in part, because the width of the receptacles 72A, 72B, as defined by the distance between the two parallel edges (72A' and 72A") and (72B' and 72B") is less than the height of whichever flute 74 of the locking tabs 70A and 70B engages the flat layer. The height of an engaging flute is defined as the distance between the flat layer and the peak of the flute. As seen in FIG. 4, the height of flute 74B would be the distance between the flat layer 74B' and its peak 74B"

In addition, as seen in FIGS. 1–3 and 5, the box also has an auxiliary or alignment closure mechanism comprised of an auxiliary locking tab and an auxiliary locking receptacle. As seen in FIG. 1, the board 10 has an auxiliary locking tab 76 formed in the cover portion 42 by a pair of angled or converging cuts of substantially equal length joined by a third cut. The board 10 further has a corresponding auxiliary receptacle 78 or hole in the cover support portion 20 formed by pushing a tab 80 which is formed by a pair of substantially parallel cuts joined by a third cut (all through both board layers) substantially perpendicular to the parallel slits up through the cover support portion 20. The receptacle 78 has a width, defined by the distance between the parallel cuts, that is narrower than at least the greatest width or the length of the third cut of auxiliary locking tab 76. When the board 10 is folded into a box, the auxiliary locking tab 76 lies substantially directly over both the auxiliary receptacle 78 and the tab 80 to facilitate a further closure mechanism of the box. The box is further sealed, as shown in FIG. 5, by pushing the auxiliary locking tab 76 downward which both pushes the tab 80 down through the board to create the auxiliary receptacle 78 and inserts the auxiliary tab 76 into the auxiliary receptacle 78. Since at least a portion of the auxiliary tab 76 is wider than the receptacle 78, the two outside edges of the tab 76 formed by the angled cuts frictionally engage the edges of the receptacle 78 formed by the parallel cuts in the cover support portion 20 to attach the cover 42 to the cover support portion 20 and to effect a closure. This auxiliary closure mechanism, as disclosed in greater detail below, also prevents the cover 42 from moving side to side in the direction of the locking tabs 70A and 70B and aids in facilitating the primary closure.

The manner of folding the single-faced board 10 of FIG. 1, which may be referred to as a food container blank, into a fully assembled box as shown in FIG. 3 is very simple and labor-saving. After a pizza or other food product has been placed on the bottom 24 of the blank 10, the cover support 20 of the board 10 is lifted upwards with respect to the bottom 24 and folded over so that it lies over the bottom 24 in a direction generally parallel to the bottom 24. During the folding over of the board, due to the score lines 12, 14 and the fact that they meet at the y-shaped slits 16, 18, the board 10 will automatically bend along the scores 12, 14, and the worker will not need to manually make a separate fold along each score 12, 14.

After the cover support 20 is folded over, the cover 42 is raised with respect to the bottom 24 and folded over the bottom 24 and cover support 20. The board 10 will automatically bend along the score lines 30, 32 so that two separate folding actions will not be necessary. As described above, when both the cover support 20 and the cover 42 are folded over, the locking tabs 70A, 70B will overlie the locking slits 72A, 72B and the auxiliary tab 76 will overlie the auxiliary receptacle 78 and tab 80. The auxiliary tab 76 is pushed through the auxiliary receptacle 78 in order to effect a partial closure of the box and to ensure proper alignment of the locking tabs 70A, 70B with the locking receptacles 72A, 72B. Each properly aligned locking tab 70A, 70B is then bent downward and inserted through the corresponding locking receptacle 72A and 72B so that a corrugated flute 74 engages the flat paperboard layer to close the box.

The automatic bending of the board along the scored lines 12, 14, is facilitated by the placement of the y-shaped cuts 16, 18 between the linear extensions of the substantially linear first portions of the scores 12, 14, and the automatic bending is also facilitated by placement of the y-shaped cuts 36, 38 between the linear extensions of the substantially linear first portions of the scores 30, 32. The y-shaped cuts in the board lessen resistance from the paperboard material itself and ease the tension of the natural spring in the folding operation which allows the box to be formed with minimum effort and prevents extra unwanted folds from being formed. The automatic bending is also facilitated by the fact that the areas between the scores 12, 14 and the scores 30, 32 are unscored so that substantially planar side walls 22, 40 are formed.

Referring to FIGS. 3 and 4, it can be seen that the third and fourth side walls of the box are formed partly by the cover 42, partly by the cover support portion 20 and partly by the bottom 24. It may be noted that the lines of corrugation or flutes of the cover 42, cover support 20 and bottom 24 are parallel to one another and to the third and fourth sidewalls after the tabs 70A and 70B are inserted in the locking slits 72A and 72B. The y-shaped cuts 16, 18, 36, 38 allow first and second portions of both the cover 42 and the cover support portion 20 to lie flat with corresponding first and second portions of the bottom 24 when the box is assembled. The first portions of the cover 42, cover support portion 20 and bottom 24 being generally between the y-shaped cut 16 at the end of the first sidewall 22 and the y-shaped cut 36 at the end of the second sidewall 40 and the second portions being between the y-shaped cut 18 at the end of the first sidewall 22 and the y-shaped cut 38 at the end of the second sidewall 40. As seen in FIG. 3 and as best seen in FIG. 4, the flutes 82 of the cover 42 and the cover support portion 20 are intimately mated with the parallel flutes 73 of the bottom 24 between each respective pair of y-shaped cuts 16 and 36, 18 and 38. This mating between the y-shaped cuts allows the flutes 82 of the cover 24 and the flutes of the cover support portion 20 to both lie in the recesses 84 between the flutes 73 of the bottom 24 and allows the flutes 73 of the bottom 24 to lie in the recesses 86 between the flutes 82 of the cover 42 and the recesses between the flutes of the cover support portion 20. This intimate mating minimizes the escape of hot air from the interior of the box through the third and fourth side walls of the box formed by the cover 42, the cover support portion 20 and the bottom 24. In addition, this intimate mating aids in preventing the closed box from being opened by providing a multidimensional lip.

As seen in FIGS. 6–9, an alternative embodiment of the present invention is provided which is substantially identical to embodiment shown in FIGS. 1–6, except that the primary closure system consists of a differently designed set of locking tabs and locking receptacles.

Figure 7:
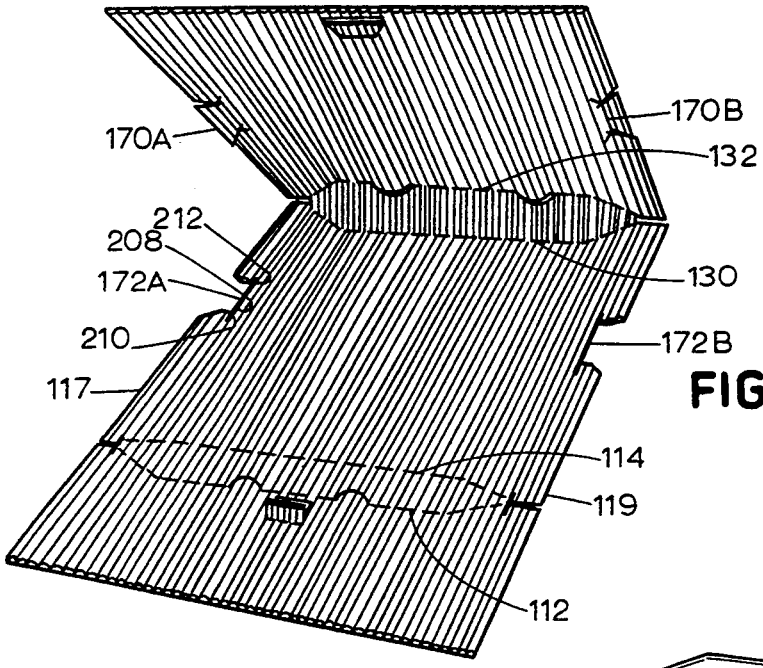
FIG. 7 is a perspective view of the container of FIG. 6 in a partially folded configuration.

As seen in FIGS. 6 and 7, a board 110, has two locking tabs 170A and 170B respectively formed at the top and bottom edges 117 and 119 and at the center of the length of the cover 142. The tabs 170A and 170B are each formed by two arrow-head shaped cuts, through both layers of the board 110, which face one another and extend from the edge of board 110 inwardly. Since tabs 170A and 170B are identical, only tab 170A will be discussed. Tab 170A is formed by a first arrow-head shaped cut 200 and a second arrow-head shaped cut 202 whose points face each other. Each arrow-head shaped cut 200, 202 respectively has a first linear portion 200A, 202A and a second linear portion 200B, 202B. The first linear portions 200A, 202A each extend from the top edge 117 of board 110 and converge towards one another. The second linear portions 200B, 202B each respectively extend from the first linear portion 200A and 202A and diverge away from one another.

The board 110 also has two locking receptacles 172A, 172B located in the center of the length of the bottom portion 124 respectively at the top and bottom edges 117, 119 of the board 110. The locking receptacles 172A, 172B are each formed by cutting out a portion of the board. Each locking receptacle 172A, 172B is identical and has three edges. For simplicity, only receptacle 172A will be discussed. Locking receptacle 172A has a first arrow-head edge 204 and second arrow-head edge 206 which point inwardly toward one another. Each arrow-head edge 204, 206 respectively consists of a first linear portion 204A, 206A and a second linear portion 204B, 206B. The first portions 204A, 206A each extends from the top edge 117 of the board 110 and converge toward one another. The second linear portions 204B, 206B extend respectively from the first linear portion 204A, 206A and are generally parallel to each other and perpendicular to the top and bottom edges 117 and 119 of the board 110. The two arrow-head edges 204, 206 are joined at their second linear portion 204B, 206B by a third edge 208 which is substantially parallel to the top and bottom edges 117 and 119 of the board 110 and the plurality of parallel flutes 173 of the bottom 124. The distance between the parallel second linear portions 204A and 206A must be less than at least a portion of the width of locking tab 172A. The width of the locking tab being defined as the distance between the first linear portions 200A and 202A of the arrow-head shaped cuts measured by a line parallel to the top and bottom edges 117, 119 of the board 110.

Figure 9:
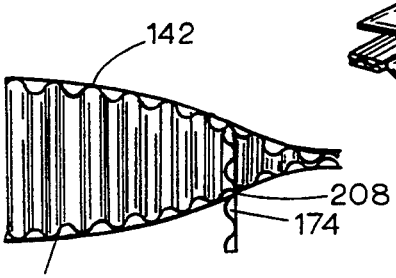
FIG. 9 is a partial side view of the container taken along lines 9—9 in FIG. 8.

The tabs 170A, 170B are positioned such that each tab positionally coincides with a locking receptacle 172A, 172B to facilitate the tight closure of the box. In particular, when the board 110 is folded into a box, the tab 170A of the cover 142 lies directly over the locking receptacle 172A in the bottom portion 124. In addition, the tab 170B formed in the cover 142 lies directly over locking receptacle 172B formed in the bottom portion 124. When the board 110 is folded along the four score lines 112, 114, 130, 132 and the tabs 170A, 170B overlie the locking receptacles 172A, 172B, as described above, the box is sealed by bending the tabs 170A and 170B to a downward pointing direction, as shown in FIG. 9, such that a corrugated flute 174 of the tab engages the flat layer of paper board at the third edge 208 of receptacle on the bottom portion 124 to facilitate the tight closure of the box.

The box is further secured and the engagement between the flutes 174 and flat layer is maintained because when the locking tab 170A (again since both locking tabs 170A and 170B and locking receptacles 172A and 170B are identical, only corresponding locking tab 170A and locking receptacle 172A will be discussed) is bent down, a portion of the locking tab 170A is wider than the width of the receptacle 172A between the parallel second linear portions 204B and 206B of the arrow-head edges. This wider portion of the locking tab 170A frictionally engages these second linear portions 204B, 206B of the arrow-head edges 204, 206 which further secures the closure and prevents the flute from disengaging.

As shown in FIGS. 6 and 7, the locking receptacle 172A can also have two slits 210 and 212 which linearly extend from each end of the third edge 208. When the locking tab 170A is pointed down to engage the flutes with the flat layer, portions of the locking tab that are wider than the parallel portions 204B and 206B of the arrow-head edges can be captured in the slits 210 and 212. This capture aids closure of the box and maintains the fluted engagement.

Though both specific primary closure mechanisms of the above embodiments differ, both embodiments have one locking tab and one locking receptacle (or one primary closure mechanism) located in the center of the length of both third and fourth sidewalls that are partly formed by the cover and partly by the bottom. It has been found that when compared to a container having more than one primary closure mechanism per sidewall and therefore having closure mechanisms which are closer to the triangular ends of the first and second sidewalls (and further away from the center of the third and fourth sidewalls), that the stacking strength of the present invention with one central closure mechanism is greater. Stacking strength being defined as the ability of sidewalls to resist deformation to weight being stacked on the container. As seen in FIG. 3, there are several three dimensional triangles formed at the four corners of the container having vertices at these points: 1) the end of the y-shaped cut; 2) the point where the first linear portion of the score meets one of the second linear portions of the score; and 3) the center of the primary locking mechanism. For illustration, these points are labelled A, B and C in FIG. 3 for one such triangle. Depending upon the location of the locking tab, the triangle can be elongated. Since the center of a multiclosure locking tab would be closer to the sidewall, at least two sides of the three dimensional triangle would be smaller than those of the three dimensional triangle formed by the present invention. The elongated three dimensional triangles of the present invention redistribute stresses which occur in normal use and provide greater stacking strength.

Further modifications and alternative embodiments of the invention will be apparent to those skilled in the art in view of the foregoing description. Accordingly, this description is to be construed as illustrative only, and is for the purpose of teaching those skilled in the art the best mode of carrying out the invention. The details of the structure and materials may be varied substantially without departing from the spirit of the invention, and the exclusive use of all modifications which come within the scope of the appended claims is reserved.

What is claimed is:

1. A container comprising:

a two-layer single-faced bottom portion, said bottom portion having a substantially flat layer on the exterior of the container and a corrugated layer on the interior of the container, said corrugated layer being adhesively attached directly to said flat layer and having a plurality of substantially parallel flutes;

a first and a second single-faced side wall each integrally formed with said bottom portion, said first and said second side walls each having first and second ends being generally triangular in shape;

a third and a fourth single-faced side wall, said third and said fourth sidewall each being formed partly by a two-layer single-faced cover and partly by said bottom portion;

said two-layer single-faced cover being integrally formed with said third and fourth side walls, said cover having a substantially flat layer on the exterior of the container and a corrugated layer on the interior of the container, said corrugated layer being adhesively attached directly to said flat layer;

at least one two-layer single-faced locking tab integrally formed with said cover, said locking tab having a substantially flat layer and a corrugated layer having a plurality of flutes, said corrugated layer being adhesively attached directly to said flat layer; and at least one corresponding locking receptacle integrally formed with said bottom portion and having an edge substantially parallel to said plurality of parallel flutes of said bottom portion, the position of each said locking tab coinciding with each said corresponding locking receptacle when said container is assembled so that each said locking tab may be bent downwards to enable a flute of said locking tab to engage said flat layer of said bottom portion by said edge of said locking receptacle to facilitate closure of said cover to said bottom portion.

2. The container of claim 1 wherein said first sidewall has a first pair of vents and said second sidewall has a second pair of vents wherein the distance between said first pair of vents is different from the distance between said second pair of vents.

3. The container of claim 1, wherein each of said locking receptacles comprises a slit having a width less than the height of said flute of said locking tab that engages said flat layer and wherein said bent locking tab is inserted through said slit to facilitate said closure.

4. The container of claim 3, having a first said locking tab located substantially at the center of the length of said third sidewall and a second said locking tab located substantially at the center of the length of said fourth sidewall.

5. The container of claim 4 further comprising a two-layer single faced cover support integrally formed with said first single-faced sidewall, said cover support having a substantially flat layer facing the cover and a corrugated layer facing said bottom, said corrugated layer being adhesively attached to said flat layer, said cover support having an auxiliary receptacle and said cover having an auxiliary locking tab, the position of said auxiliary tab coinciding with said auxiliary receptacle when said container is assembled so that said auxiliary tab may be bent downward to frictionally engage said auxiliary receptacle to form a closure between said cover and said cover portion.

6. The container of claim 4 wherein the first and second ends of said first and second sidewalls are y-shaped cut.

7. The container of claim 6 wherein a portion of the flutes of the cover intimately mate with a portion the flutes of the bottom between said first y-shaped cut end of said first sidewall and said first y-shaped cut end of said second wall when said container is assembled to prevent thermal loss from within the interior of the container.

8. A container comprising:

a two-layer single-faced bottom portion, said bottom portion having a substantially flat layer on the exterior of the container and a corrugated layer on the interior of the container, said corrugated layer being adhesively attached directly to said flat layer and having a plurality of substantially parallel flutes;

a first and a second single-faced side wall each integrally formed with said bottom portion, said first and said second side walls each having first and second ends being generally triangular in shape;

a third and a fourth single-faced side wall, said third and said fourth sidewall each being formed partly by a two-layer single-faced cover and partly by said bottom portion;

said two-layer single-faced cover being integrally formed with said third and fourth side walls, said cover having a substantially flat layer on the exterior of the container and a corrugated layer on the interior of the container, said corrugated layer being adhesively attached directly to said flat layer;

at least one two-layer single-faced locking tab integrally formed with said cover, said locking tab having a substantially flat layer and a corrugated layer having a plurality of flutes, said corrugated layer being adhesively attached directly to said flat layer; and at least one corresponding locking receptacle integrally formed with said bottom portion and having a first, second and third edge, said first edge substantially parallel to said plurality of parallel flutes of said bottom portion, the position of each said locking tab coinciding with each said corresponding locking receptacle when said container is assembled so that each said locking tab may be bent downwards to enable a flute of said locking tab to engage said flat layer of said bottom portion by said edge of said locking receptacle and a first and a second portion of said locking tab respectively frictionally engages said second and third edges of said locking receptacle to facilitate closure of said cover to said bottom portion.

9. The container of claim 8 wherein said first sidewall has a first pair of vents and said second sidewall has a second pair of vents wherein the distance between said first pair of vents is different from the distance between said second pair of vents.

10. The container of claim 8, wherein each said second and third edge of each of locking receptacles has a first portion extending from said first edge, said first portion of said second edge being generally parallel to said first portion of said third edge, wherein the distance between said first portions is about the length of said first edge and wherein a portion of the width of said locking tab is greater than the length of said first edge and wherein the locking tab frictionally engages said first portions of said second and third edges to facilitate said closure.

11. The container of claim 10, having a first said locking tab located substantially at the center of the length of said third sidewall and a second said locking tab located substantially at the center of the length of said fourth sidewall.

12. The container of claim 11 further comprising a two-layer single faced cover support integrally formed with said first single-faced sidewall, said cover support having a substantially flat layer facing the cover and a corrugated layer facing said bottom, said corrugated layer being adhesively attached to said flat layer, said cover support having an auxiliary receptacle and said cover having an auxiliary locking tab, the position of said auxiliary tab coinciding with said auxiliary receptacle when said container is assembled so that said auxiliary tab may be bent downward to frictionally engage said auxiliary receptacle to form a closure between said cover and said cover portion.

13. The container of claim 11 wherein the first and second ends of said first and second sidewalls are y-shaped cut.

14. The container of claim 13 wherein a portion of the flutes of the cover intimately mate with a portion the flutes of the bottom between said first y-shaped cut end of said first sidewall and said first y-shaped cut end of said second wall when said container is assembled to prevent thermal loss from within the interior of the container.

* * * * *

UNITED STATES PATENT AND TRADEMARK OFFICE

CERTIFICATE OF CORRECTION

PATENT NO. : 5,358,174

DATED : October 25, 1994

INVENTORS : ANTCZAK ET AL.

It is certified that error appears in the above-identified patent and that said Letters Patent is hereby corrected as shown below:

Column 4, line 4, "state;" should be --state; and--.

Figure 8:
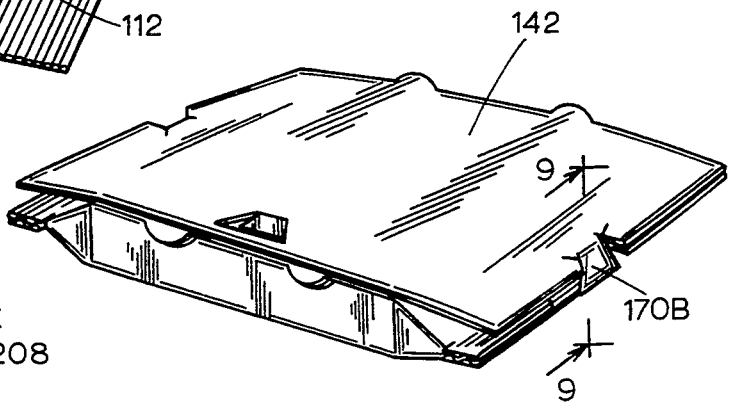
FIG. 8 is a perspective view of the container in its assembled state.

Column 4, line 6, "FIG. 8;" should be --FIG. 8.--.

Column 4, line 57, "12B 14B" should be --12B, 14B--.

Column 6, line 53, "peak 74B"" should be --peak 74B".--.

Signed and Sealed this

Tenth Day of October, 1995

*Attest:*

Bruce Lehman

BRUCE LEHMAN

*Attesting Officer*

*Commissioner of Patents and Trademarks*